US006981573B2

(12) United States Patent
Nickel

(10) Patent No.: US 6,981,573 B2
(45) Date of Patent: Jan. 3, 2006

(54) SCAFFOLD LIFT SYSTEM

(75) Inventor: Shane L. Nickel, Fargo, ND (US)

(73) Assignee: Reechcraft, Inc., Fargo, ND (US)

( * ) Notice: Subject to any disclaimer, the term of this patent is extended or adjusted under 35 U.S.C. 154(b) by 7 days.

(21) Appl. No.: 10/643,156

(22) Filed: Aug. 18, 2003

(65) Prior Publication Data

US 2005/0039984 A1 Feb. 24, 2005

(51) Int. Cl.
*E04G 1/18* (2006.01)

(52) U.S. Cl. ..... 182/141; 74/425; 74/424.6

(58) Field of Classification Search ..... 182/141, 182/146, 150, 82, 13, 16; 108/147, 149; 74/412 R, 425, 424.6, 422; 187/270, 254, 187/255, 213, 214, 271, 244
See application file for complete search history.

(56) References Cited

U.S. PATENT DOCUMENTS 4,294,332 A * 10/1981 Ready ..... 182/141
4,552,403 A * 11/1985 Yindra ..... 108/147
4,600,085 A * 7/1986 Gagnon et al. ..... 187/268
4,887,694 A * 12/1989 Ho ..... 182/141
4,967,733 A * 11/1990 Rousseau ..... 182/141
5,310,018 A * 5/1994 Lahaie ..... 182/141
6,119,605 A * 9/2000 Agee ..... 108/147
6,247,273 B1 6/2001 Nickel
6,523,647 B2 * 2/2003 Duplessis ..... 187/270
6,676,233 B1 * 1/2004 Evans et al. ..... 182/141
6,793,039 B2 * 9/2004 Schmid, Jr. ..... 182/141

OTHER PUBLICATIONS

MonoJack™ by ReechCraft, http://www.reechcraft.com/monojack/info.html, last updated Nov. 18, 2003, 1 page.
Panel Jack™ by ReechCraft, http://www.reechcraft.com/paneljack/index.html, last updated Nov. 18, 2003, 1 page.
Panel Jack™ by ReechCraft, http://www.reechcraft.com/paneljack/info.html, last updated Nov. 18, 2003, 2 pages.
Bronco by Reechcraft, "Bronco™, The Best Horse In The Business," p://www.broncosystem.com/bronco.index.html, last updated Nov. 18, 2003, 2 pages.

* cited by examiner

*Primary Examiner*—Hugh B. Thompson, II
(74) *Attorney, Agent, or Firm*—Merchant & Gould PC

(57) ABSTRACT

A scaffolding system has a pair of vertical posts supporting a platform traveling vertically on the posts. A traveler device attaches to and engages each of the vertical posts and supports the platform. Each traveler device has a sprocket gear engaging a complementary track extending up the post so that rotation of the gear moves the traveler device along the vertical post and lifts and lowers the platform. The traveler device has a worm type drive gear configured for receiving a driver and meshing with the sprocket gear. The drive gear is operated with a power drill or a crank drive. The platform includes a foot operated brake device providing a back up system to prevent the platform from accidentally dropping.

15 Claims, 8 Drawing Sheets

SCAFFOLD LIFT SYSTEM

BACKGROUND OF THE INVENTION

1. Field of the Invention

The present invention relates to a lift system, and in particular to a lift system such as may be utilized for lowering and raising scaffolding.

2. Description of the Prior Art

Scaffolding is commonly used in the building industry where workers are erecting walls or working at an elevated position. Multiple story scaffolding systems are typically self supporting, such as tower scaffolding. For systems that are needed for raised elevations, but are not raised more than one or two stories above the ground, scaffolding may be supported by the building or structure being erected or worked on.

A common system for such lower level elevated applications has been a pump jack system. Pump jack systems normally include a pair of posts with each post including a pump jack connected thereto. The jacks support a platform for workers to stand on. Pump jacks typically are pedal operated to raise the platform on the posts and often utilize a hand operated crank to lower the platform. Both the crank and pedal are typically actuated by the worker standing on the platform.

Although such systems may be workable for certain applications, there are several drawbacks. The pump jack type systems require much exertion from the operator to raise or lower the pump jacks and scaffolding platform. In addition, the systems are complicated and require extra time for setting up and disassembly. Such systems have many moving parts and are not easily transported. Such systems are also difficult to use in inclement weather or at lower temperatures.

It can be seen then that a new and improved system is needed for lifting platforms and scaffolding systems. Such a system should provide for easy setup and take down as well as being easily transported. In addition, such a system should be easily operated by scaffolding users with minimal effort and provide for improved safety. The present invention addresses these as well as other problems associated with scaffolding lift systems.

SUMMARY OF THE INVENTION

The present invention is directed to a scaffolding lift system. The scaffolding system includes two vertical posts or poles that are engaged by and support a platform assembly configured for allowing workers to stand on or walk on while working. The platform preferably includes rails and a shelf for holding materials. In one embodiment, the platform may include a caddy and rails for providing for movement of the caddy along the platform.

The posts may include upper supports extending outward to engage the vertical surface of the wall for additional support. The posts also have a toothed track formed along one side for engagement by a complementary traveler device mounted to the platform assembly. The traveler device provides for lifting and lowering of the platform assembly along the post. The traveler device has a housing including rollers engaging opposite ends of the posts, along one side of the post along is formed the toothed track. A spur gear extends inward from the traveler device to engage the toothed track. Rotation of the spur gear lifts and lowers the traveler device, depending on the direction of rotation. The sprocket gear is driven by a worm type gear that includes an actuator engagement portion. The actuator engagement portion may be attached to a drill having a special fitting, such as a hex head to drive the worm gear. A crank may also be utilized for rotating the worm gear. The worm gear rotates several times for each rotation of the sprocket, thereby providing a mechanical advantage so that the platform assembly may be easily lowered and raised by one person, even when supporting workers and their gear. In addition, the drive train and gears provide a natural braking resistance so that the platform assembly does not accidentally slide down the posts under its own weight. In addition to the resistance and braking characteristics of the drive system, a separately operated foot brake also engages the toothed track and provides additional backup. The foot brake may be easily actuated and disengaged while the user's foot is also actuating the traveler device. The brake is typically spring loaded and configured to ride over the teeth when raised.

The present invention overcomes the drawbacks of the prior art and provides easy actuation, transport and assembly that is not provided for in the prior art. The present provides a safe scaffolding system that is reliable under all types of weather conditions and that does not require complicated machinery or an engine to run.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
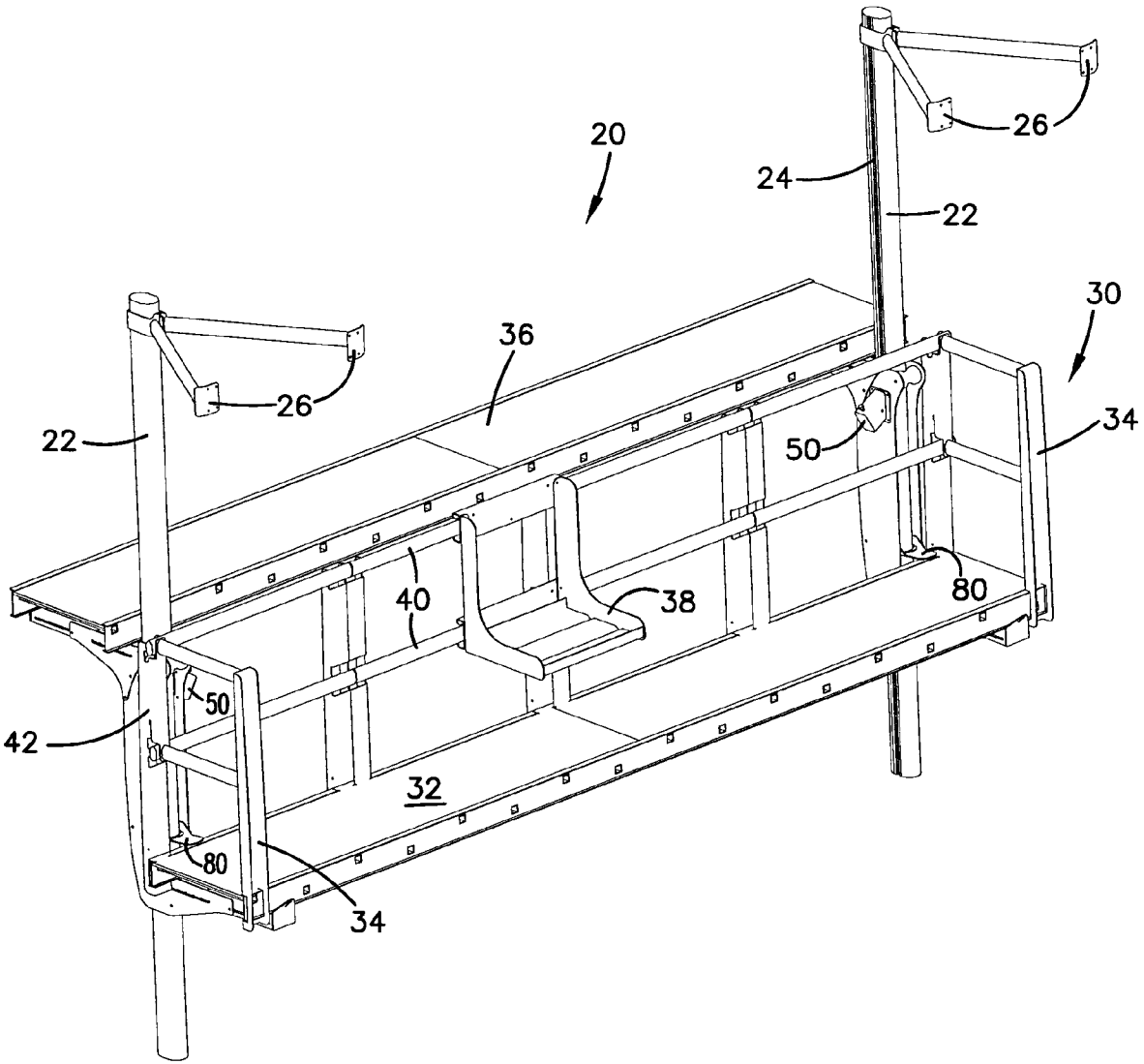
FIG. 1 shows a perspective view of a scaffolding system according to the principles of the present invention.
Figure 2:
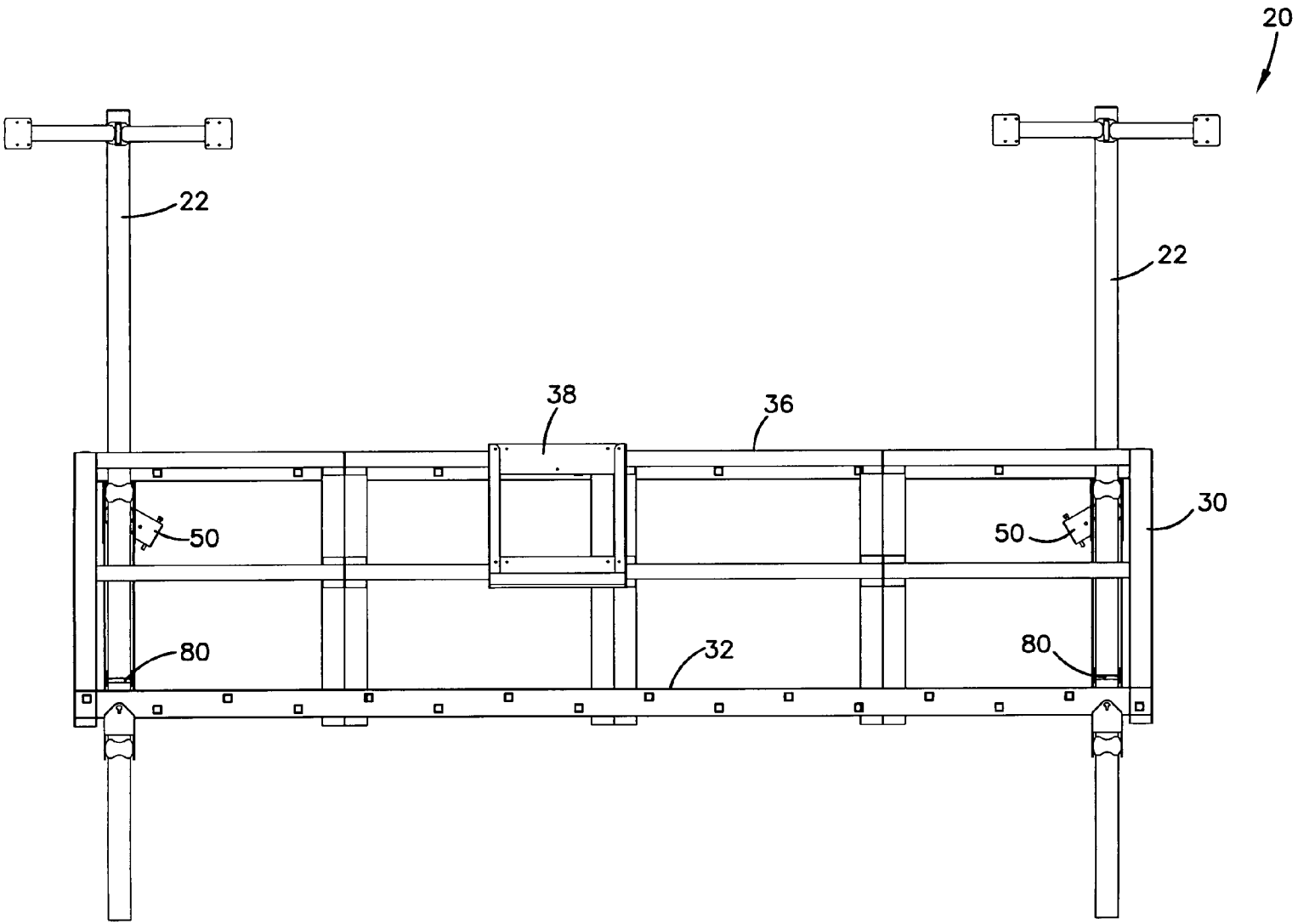
FIG. 2 shows a front elevational view of the scaffolding system of FIG. 1.
Figure 3:
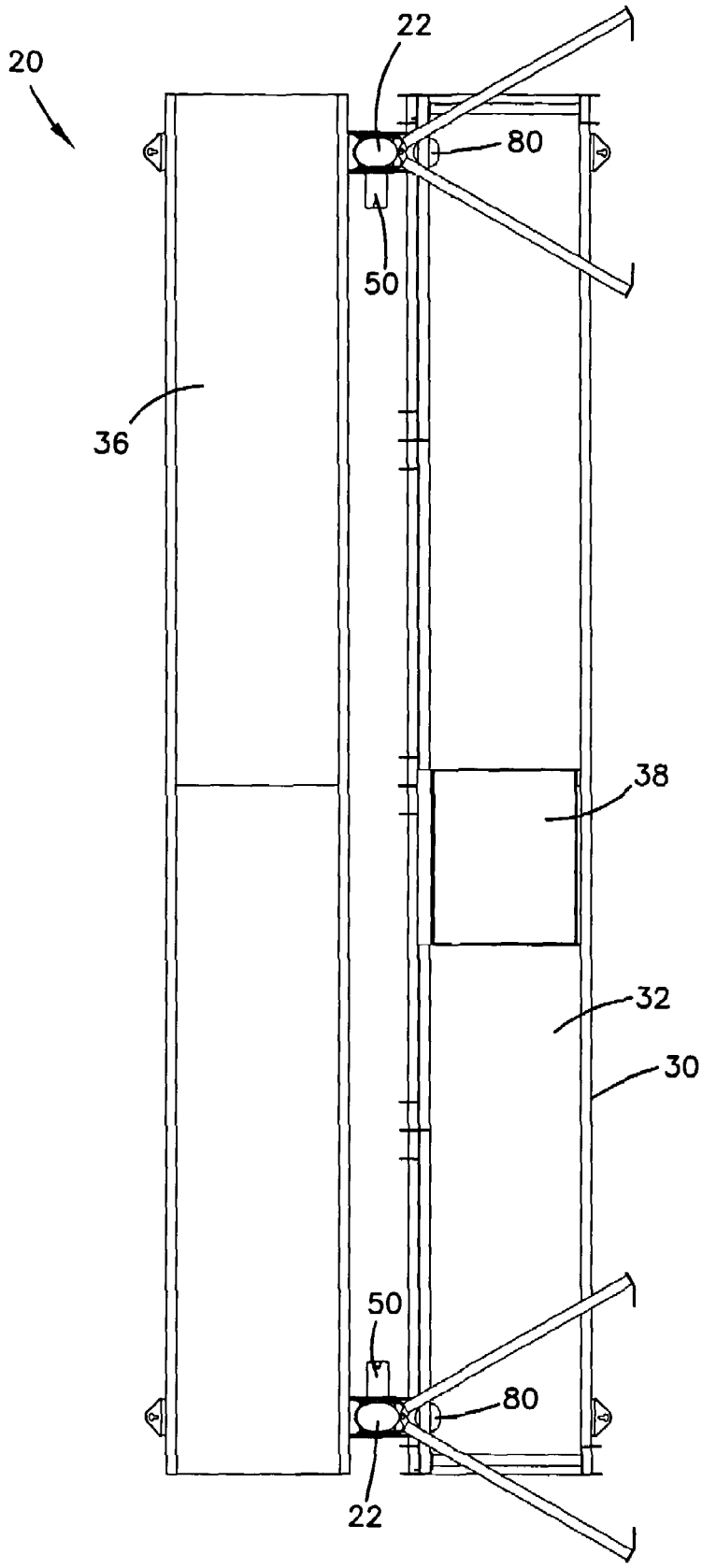
FIG. 3 shows a top plan view of the scaffolding system of FIG. 1.
Figure 5:
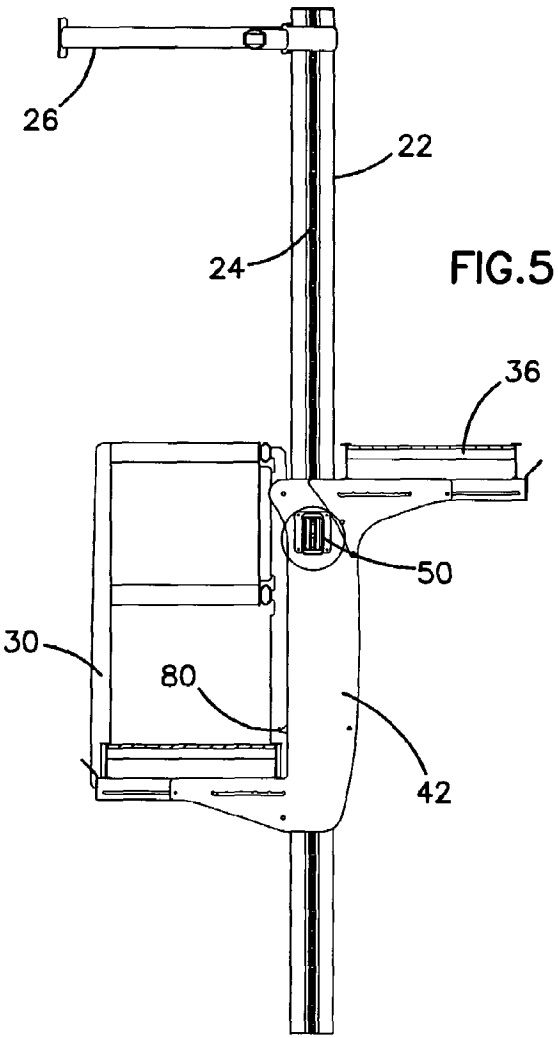
FIG. 5 shows an end sectional view with of the scaffolding system taken along line 5—5 of FIG. 2.
Figure 4:
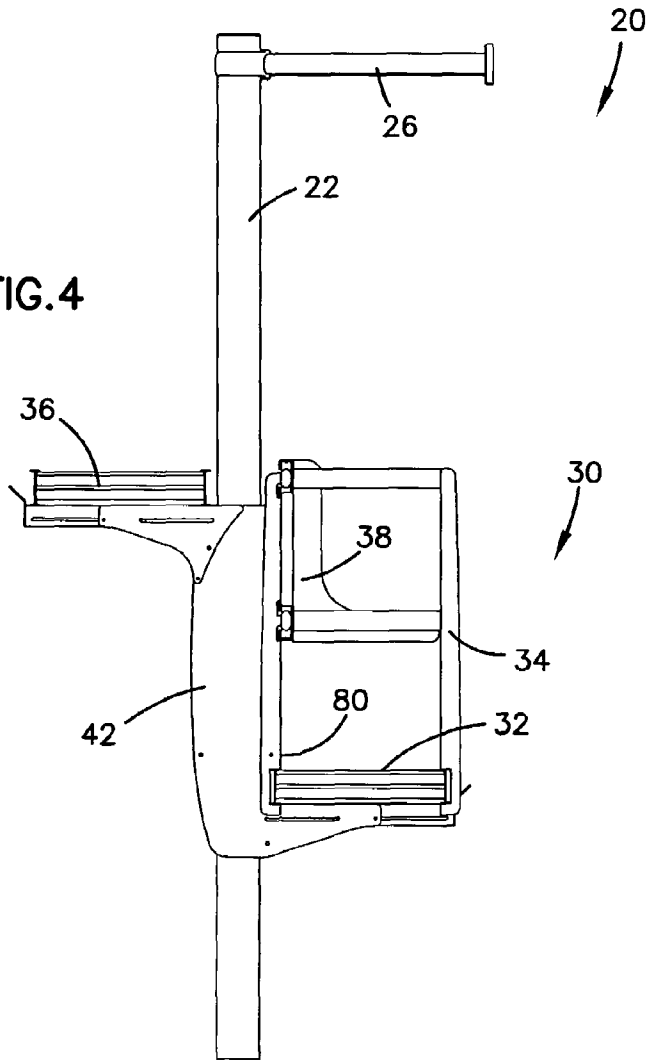
FIG. 4 shows an end view of the scaffolding system of FIG. 1.
Figure 8:
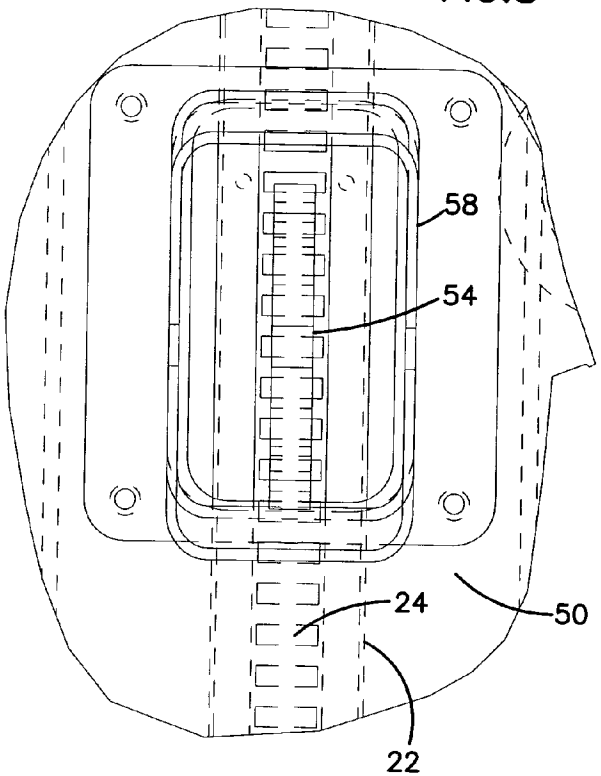
FIG. 8 shows an end partial sectional view of the traveler device of FIG. 6.

Referring now to the drawings and in particular to FIGS. 1–5, there is shown a scaffolding system, generally designated 20, according to the principles of the present invention. The scaffolding system 20 includes a platform assembly 30 supported on a pair of poles or posts 22 with one disposed at each end of the platform assembly 30. The posts 22 include wall supports 26 that are configured for positioning the system 20 relative to a wall and also provide additional support at the upper end of each post 22. The platform assembly 30 includes a deck 32 configured for allowing workers to stand and walk on during use. Railings 34 extend around portions of the deck 32 and provide for additional safety and support. An upper shelf or ledge 36 is positioned above the deck 32 and on the opposite side of the post 22. The shelf 36 is typically utilized for storing materials and supplies.

The platform assembly 30 may also include a caddy 38 slidably mounted on rails 40 that may also form a portion of the railing 34. A mounting portion 42 supports the platform assembly 30 and includes a first embodiment of a traveler device 50 shown in FIGS. 6–9 or a second embodiment of a traveler device 150 shown in FIGS. 10–11, which engages the associated post 22, as further explained below.

Figure 6:
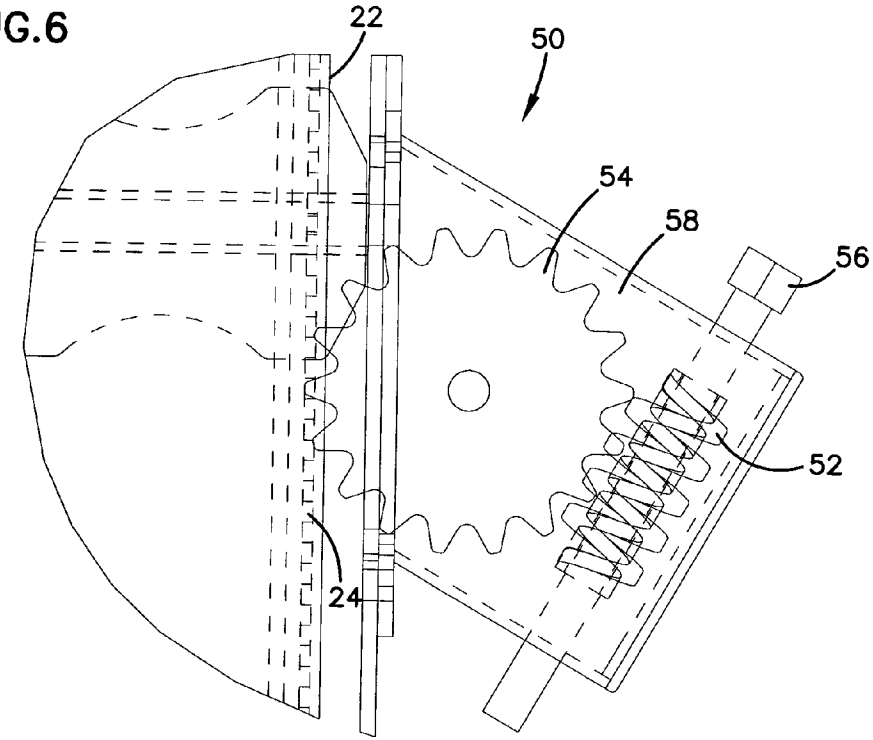
FIG. 6 shows a side partial sectional view of a first embodiment of a traveler device for the scaffolding system of FIG. 1.
Figure 7:
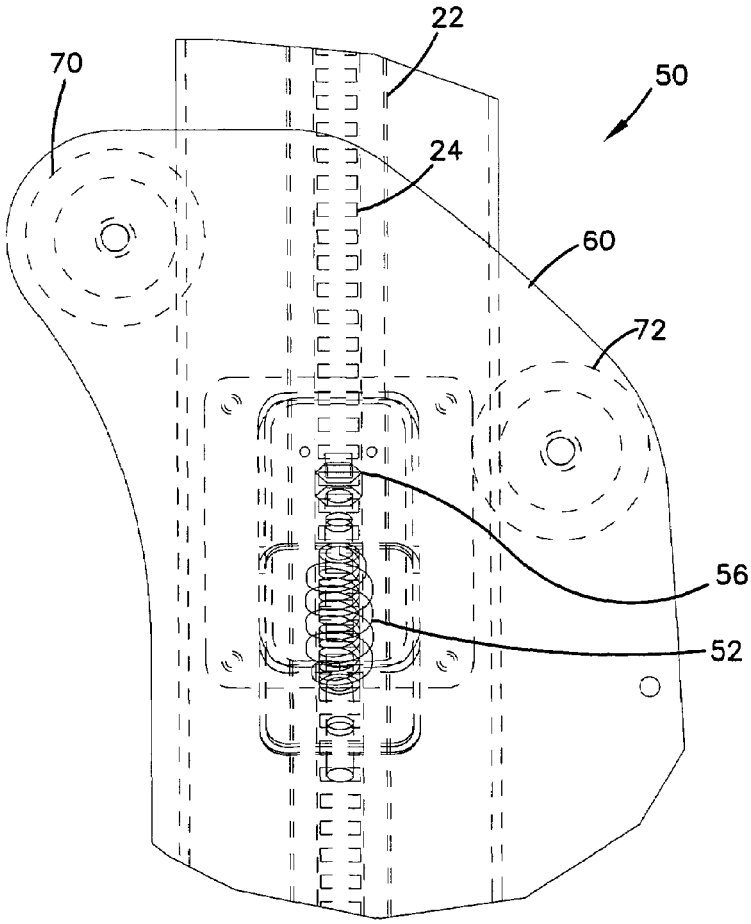
FIG. 7 shows a side sectional view of the traveler device of FIG. 6 and rollers for the scaffolding system of FIG. 1.

Referring now to FIGS. 6–9, each of the lift devices 50 travels vertically along its associated post 22. The lift device 50 includes a gear housing 58 attached to a roller housing 60. The roller housing 60 is configured to extend around the posts 22 and receive rollers 70 and 72 that engage opposite ends of the generally oval posts 22. The rollers 70 are typically made of a plastic or other material and are spaced apart, as shown in FIG. 7, to provide added engagement security. The rollers 70 include an arcing contour that substantially matches the corresponding outer surface of the associated post 22. The rollers 70 of each traveler device 50 engage the associated post 22 at different heights, as shown in FIG. 7, for improved support and alignment.

Figure 9:
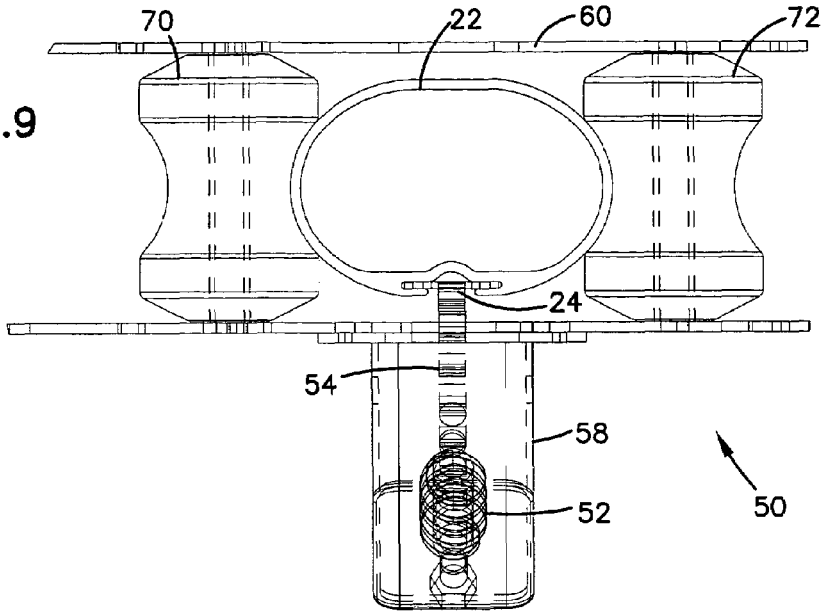
FIG. 9 shows a top view of the traveler device of FIG. 6.

As shown in FIG. 9, on one side of the post 22 is formed the track 24 having teeth disposed there along that engage complementary teeth on a gear on the traveler assembly, as shown most clearly in FIG. 6. A spur type gear 54 has teeth that mate to the teeth of the track 24. Therefore, as the gear 54 is rotated, the lift device 50 moves up and down the posts 22. The gear 54 is actuated by a worm gear 52 positioned at the side of the gear 54 opposite the posts 22. The worm type gear 52 engages the sprocket type gear 54 and rotation of the worm gear 52 actuates the spur 54. The spur gear 54 does not rotate as often as the worm gear 52, so that a mechanical advantage is provided. The worm gear 52 includes a driver engagement 56. The driver engagement 56 is configured to couple to a tool, such as a power drill or a hand crank. In this manner, a cordless drill, such as is often utilized for tasks performed on the scaffolding assembly 20, may be placed on the engagement portion 56 and the scaffolding may be easily raised or lowered with mechanical advantage provided through the gear drive train. The housing 58 is angled for easier access and actuation of the driver engagement 56 by a worker with either a crank or drill.

Referring again to FIG. 1, as a safety precaution, a brake 80 mounts to the platform assembly 30 and also engages the teeth of the track 24. The brake 80 is easily operated with the users foot and is spring loaded to prevent accidental uncoupling. The brake 80 acts as a secondary safety device as the gears 52 and 54 have sufficient resistance that the platform assembly 30 cannot accidentally drop or slip under its own weight, or when loaded.

In use, the brake 80 is disengaged from each of the posts 22 and the actuator, such as a drill or hand crank, is attached to the driver engagement portion 56 of the worm gear 52. The drills are rotated in the same direction to either raise or lower each of the lift devices 50, thereby raising or lowering the platform assembly 30 relative to the posts 22. It can also be appreciated that the lift devices 50 may be operated independently so long as the devices are moved only a short distance at a time and alternated. The brake 80 is also configured to ride over the tracks 24 on the way up so that the brake 80 need not be disengaged in order to raise the platform, only to lower the platform assembly 20, thereby acting as a ratchet device.

Figure 10:
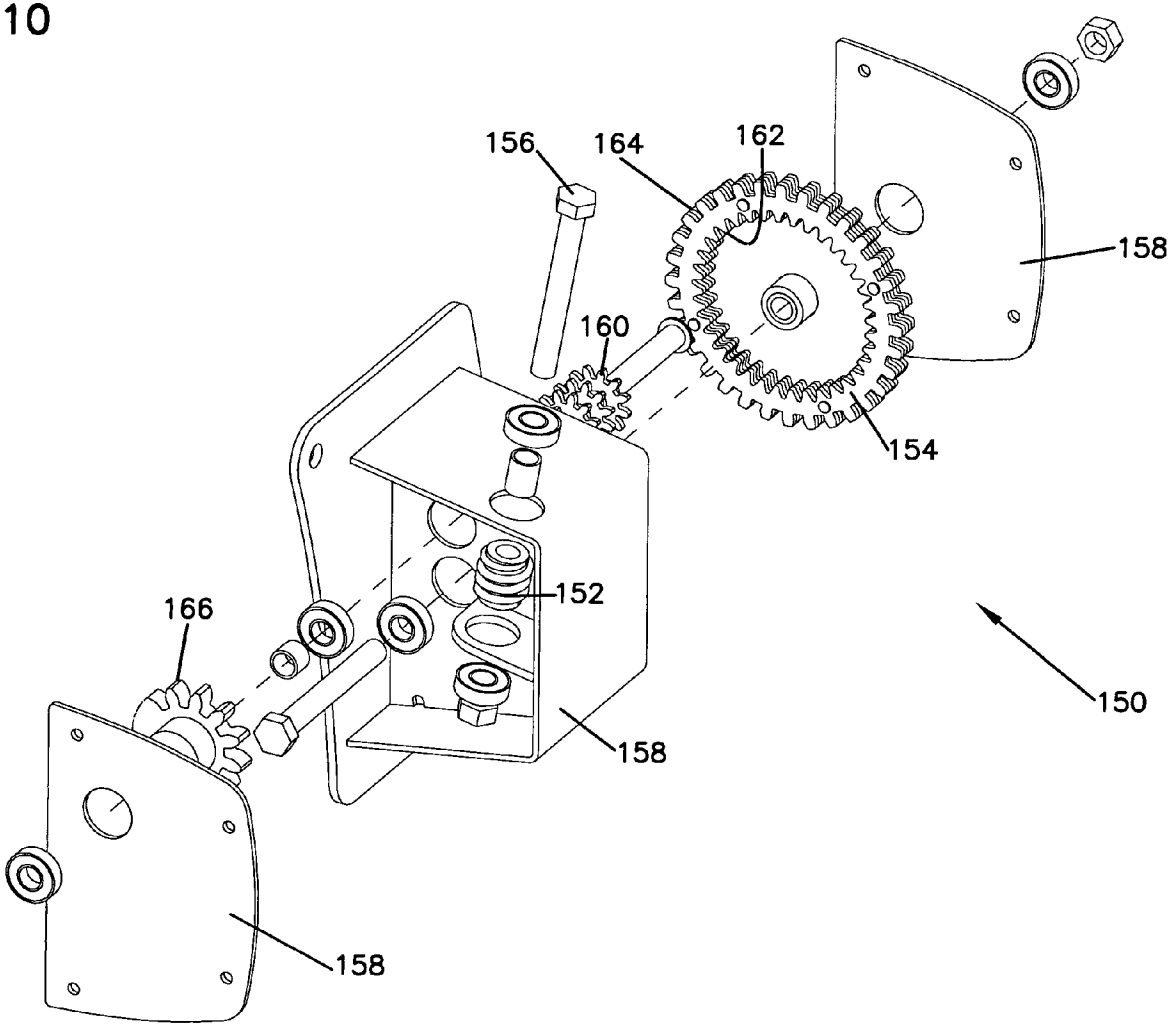
FIG. 10 is an exploded perspective view of a second embodiment of a traveler device for the scaffolding system of FIG. 1.
Figure 11:
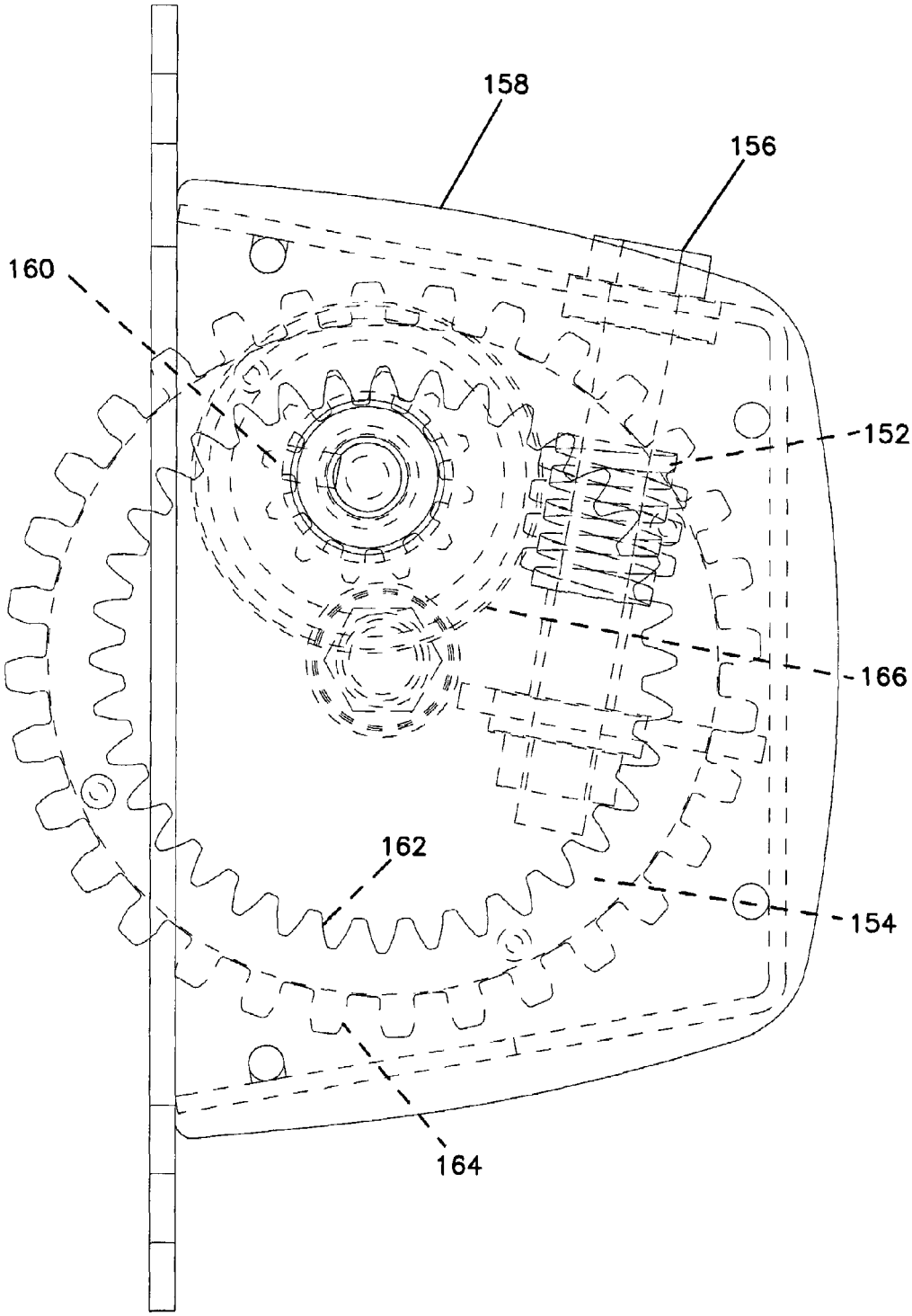
FIG. 11 shows a side sectional view of the traveler device shown in FIG. 10.

Referring now to FIGS. 10 and 11, a second embodiment of the traveler device 150 is shown. The traveler device 150 operates in a similar manner to the traveler device 50, but includes additional gears to provide a greater mechanical advantage for applications in which a different gear ratio is needed. The traveler device 150 mounts in a similar manner and engages the teeth of the track 24 in the same manner as the traveler device 50. The traveler device 150 includes a housing 158 retaining a drive train for the traveler device 150. A planetary spur type gear 154 has exterior teeth 164 that mate to the teeth of the track 24. The traveler device 150 is driven by a worm gear 152 receiving an input from a driver with an engagement portion 156. The driver engagement 156 is configured to couple to a tool, such as a power drill or hand crank. The drive engagement 156 is directly mounted to a worm gear 152 that rotates with the driver. The worm gear 152 engages a spur gear 166 coaxially mounted to a second set of spur gears 160. The spur gears 160 are shown as three gears formed out of thin material, but may also be a single monolithic gear. Rotation of the worm gear 152 drives the spur gear 166 and the gears 160. The gear 160 engages interior teeth 162 of the planetary type spur gear 154 while exterior teeth 164 engage the track 24. Therefore, as the worm gear 152 is rotated, it drives the gear 154 moving the traveler device 150 and therefore, the scaffolding 20 up and down. It can be appreciated that the traveler device 150 provides a reduction between the rotation of the worm gear 152 through the gear train 166, 160 and 154. The traveler device also provides a further reduction and greater mechanical advantage so that less power is needed for input and provide for easier lifting and lowering of the entire scaffolding system and greater capacity with less power.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A scaffolding system comprising:

a plurality of vertical posts;

a traveler device attached to and engaging one of the plurality of vertical posts; wherein the traveler device includes a drive gear configured for receiving a driver and a second gear engaging a complementary track on one of the vertical posts, wherein rotation of the drive gear rotates the second gear and moves the traveler device along the vertical post;

a platform mounted to the traveler device.

2. A scaffolding system according to claim 1, wherein the traveler device comprises a gear and the vertical post comprises a complementary track, wherein rotation of the gear moves the traveler device along the vertical post.

3. A scaffolding system according to claim 1, wherein the traveler device comprises a driver engagement adapted to be operated with a tool.

4. A scaffolding system according to claim 1, wherein the drive gear comprises a worm gear.

5. A scaffolding system according to claim 1, further comprising a brake device mounted to the platform and engaging the track.

6. A support apparatus, comprising:

a vertical post having a track;

a traveler device mounting to the post and having a drive assembly including a first gear engaging the track and an actuator with an engagement portion configured for engagement by an actuator tool, wherein activating the actuator rotates the first gear and moves the traveler device along the post;

a support member attached to the traveler device.

7. A support apparatus according to claim 6, further comprising a brake device on the support member engaging the track.

8. A support apparatus according to claim 7, wherein the brake device comprises a foot operated brake device.

9. A support system for scaffolding, comprising:

a plurality of vertical posts;

at least one traveler device mounted to one of the plurality of vertical posts and moving up and down the vertical post;

a support member adapted for supporting scaffolding on the traveler device;

a foot operated brake device mounted to the support member and engaging the vertical post.

10. A support system according to claim 9, wherein the traveler device comprises an input gear and drive gear.

11. A support system according to claim 10, wherein the traveler device further comprises spacer rollers engaging the vertical post.

12. A support system for scaffolding, comprising:

a plurality of vertical posts;

a traveler device having an input gear and a drive gear, wherein the traveler device is mounted to one of the plurality of vertical posts and moves up and down the vertical post;

wherein the input gear includes an engagement portion configured to receive a driver at an oblique angle to vertical;

a support member adapted for supporting scaffolding on the traveler device.

13. A support system for scaffolding, comprising:

two vertical posts, each of the vertical posts comprising a toothed track;

a traveler device mounted to each of the vertical posts and moving up and down the vertical posts, the traveler device comprising a worm gear driving a sprocket gear engaging the toothed track of the vertical post, wherein rotation of the worm gear drives the sprocket and moves the traveler device along the vertical post;

a support member attached to each traveler device and supporting a platform assembly; and a foot operated brake device mounted to the support member and engaging the toothed track.

14. A support system for a platform, comprising:

a plurality of vertical posts;

a traveler device mounted to one of the plurality of vertical posts and moving up and down the vertical post, wherein the traveler device comprises a self-contained drive train configured for engagement by a hand held tool to actuate the drive train and move the traveler device along the vertical post;

a platform mounted to the traveler device.

15. A support system for a platform, comprising:

a plurality of vertical posts;

a traveler device mounted to one of the plurality of vertical posts and moving up and down the vertical post;

a platform mounted to the traveler device;

wherein the traveler device comprises a self-contained drive train configured for engagement by a portable device supported on and moving with the platform to actuate the drive train and move the traveler device along the vertical post.

* * * * *